United States Patent [19]

Marble

[11] Patent Number: 5,050,759

[45] Date of Patent: Sep. 24, 1991

[54] INFANT DRINKING CUP

[76] Inventor: Alan D. Marble, 1501 Pineville Rd., Apt. 3A, Neosho, Mo. 64850

[21] Appl. No.: 596,358

[22] Filed: Oct. 12, 1990

[51] Int. Cl.[5] ..... A47G 19/22

[52] U.S. Cl. ..... 220/90.4; 220/90.2

[58] Field of Search ..... 220/90.2, 90.4, 90.6, 220/85 CH, 85 SP; 215/1 A

[56] References Cited

U.S. PATENT DOCUMENTS

| | | | |
|---|---|---|---|
| D. 165,778 | 1/1952 | Olsen | 220/90.6 X |
| 2,414,697 | 1/1947 | Pettersson | 220/90.4 |
| 2,534,614 | 12/1950 | Michael | 220/90.4 |
| 3,421,681 | 1/1969 | Frank | 229/43 |
| 3,468,445 | 9/1969 | Ballin | 215/11 |
| 3,739,938 | 6/1973 | Faz | 220/90.4 |
| 4,083,467 | 4/1978 | Mullins et al. | 220/90 |
| 4,113,135 | 9/1978 | Yamazaki | 220/268 |
| 4,121,731 | 10/1978 | Okerstrum | 220/90.4 |
| 4,146,157 | 3/1979 | Dixon, Sr. et al. | 220/90.4 X |
| 4,243,156 | 1/1981 | Lobbestael | 220/90.4 X |
| 4,303,170 | 12/1981 | Panicci | 220/70 |
| 4,388,996 | 6/1983 | Panicci | 220/70 |
| 4,485,963 | 12/1984 | Panicci | 229/7 |
| 4,600,111 | 7/1986 | Brown | 215/6 |
| 4,693,410 | 9/1987 | Selz | 229/1.5 |
| 4,726,553 | 2/1988 | Wischusen | 248/146 |
| 4,832,201 | 5/1989 | Kenyon, 2nd | 206/515 |
| 4,832,212 | 5/1989 | Askinazi | 215/10 |
| 4,850,496 | 7/1989 | Rudell et al. | 215/12.1 |
| 4,921,112 | 5/1990 | Juhlin et al. | 220/90.2 X |
| 4,925,052 | 5/1990 | Betka et al. | 220/90.4 |
| 4,953,737 | 9/1990 | Meyers | 220/90.4 X |
| 4,961,510 | 10/1990 | Dvoracek | 220/90.4 |

*Primary Examiner*—Stephen P. Garbe
*Assistant Examiner*—Vanessa M. Roberts
*Attorney, Agent, or Firm*—Mark G. Kachigian

[57] ABSTRACT

A combination drinking cup and lid for liquid. A cup has a continuous, substantially cylindrical wall and a substantially circular opening at a longitudinal end of the cylindrical wall. A removable lid for closure of the opening has an edge mating with the circular opening of the cup. A spout is located near the circumferential edge of the lid and a weight is located near the circumferential edge radially opposed from the spout. When the cylindrical wall rests on a surface, the force of gravity will radially rotate the cup and the lid so that the weight will rotate towards the surface and the spout will rotate away from the surface.

11 Claims, 3 Drawing Sheets

INFANT DRINKING CUP

BACKGROUND OF THE INVENTION

1. Field of the Invention.

The present invention relates to a combination drinking cup and lid for infants which minimizes the amount of liquid spilled in the event the cup is tipped on its side.

2. Prior Art

Making the transition from a nursing bottle to a drinking glass for an infant is not an easy one. Even with a lid on a cup, the contents may be spilled through a spout. When the cup and lid are overturned, the contents will empty through the spout. Preventing spillage while providing a drinking cup that is easy to use for a child is a problem.

Several approaches have been taken to address this problem.

Paz (U.S. Pat. No. 3,739,938) discloses a drinking cup in which the contents will not spill out when the vessel is dropped. A manually depressible plunger seals off the inner ends of the spout and air vent, thereby preventing spillage.

Another approach is to insert a weighted material into the base of the cup. Panicci (U.S. Pat. No. 4,303,170) discloses a self-righting cup which will operate even when the cup is filled. A weighted material is placed in the base of the cup. Panicci (U.S. Pat. No. 4,388,996) features a weighted, self-righting cup with a ratio of the outer diameter of the cup at the point of intersection of the upper and bottom portion to the effective height of the cup portion being at least three. The use of a weighted base portion, however, requires a fairly heavy cup which is somewhat difficult for a child to handle.

Another approach identifies the use of radial rotation of the cup itself. Mullins et al (U.S. Pat. #4,083,467) segments the cup itself so that only one longitudinal section is filled with liquid while the other section is empty. If the cup is on its side, the weight of the liquid filled portion will cause radial rotation of the cup away from the spout. This requires a relatively complicated chamber arrangement and cuts down on the amount of liquid held in the cup.

A further problem encountered is when the lid is removed from the cup for cleaning. When in a dishwasher, the lid can be pushed away from the racks where it may be inconvenient to retrieve or where it may be damaged by the hot coil. After washing, it is convenient to store the lid with the cup but not in the closed position. When a number are stored together, it is inconvenient to match the proper lid with the proper cup.

Accordingly, it is a principal object and purpose of the present invention to provide a combination drinking cup and lid which will rotate about a longitudinal axis when tipped off its base in order to rotate the spout to minimize spilling.

SUMMARY OF THE INVENTION

The combination drinking cup and lid of the present invention includes a cup having a substantially flat base upon which the cup will rest. The base has a circular outer edge from which an upstanding wall extends longitudinally. The continuous wall may be in the form of a frustum or a cylinder or a combination of the two.

Longitudinally opposite the base, the cup has an open end.

The open end is adapted to receive a lid having an extending spout which terminates in a number of openings to allow liquid to exit therefrom. The lid has a portion having a cylindrical edge. The diameter of the cylindrical edge is slightly smaller than the inside diameter of the wall.

The lid has a weight which is located near the circumferential edge radially opposed from the spout.

Extending from the lid is a clip arm which may be used to secure the lid to the cup during storage or during cleaning in a dish washer.

When the cup is tipped off the base and onto the sidewall, the force of gravity will cause the weight in the lid to be forced downward, causing the spout to rotate away from the surface.

DETAILED DESCRIPTION OF THE PREFERRED EMBODIMENTS

Figure 1:
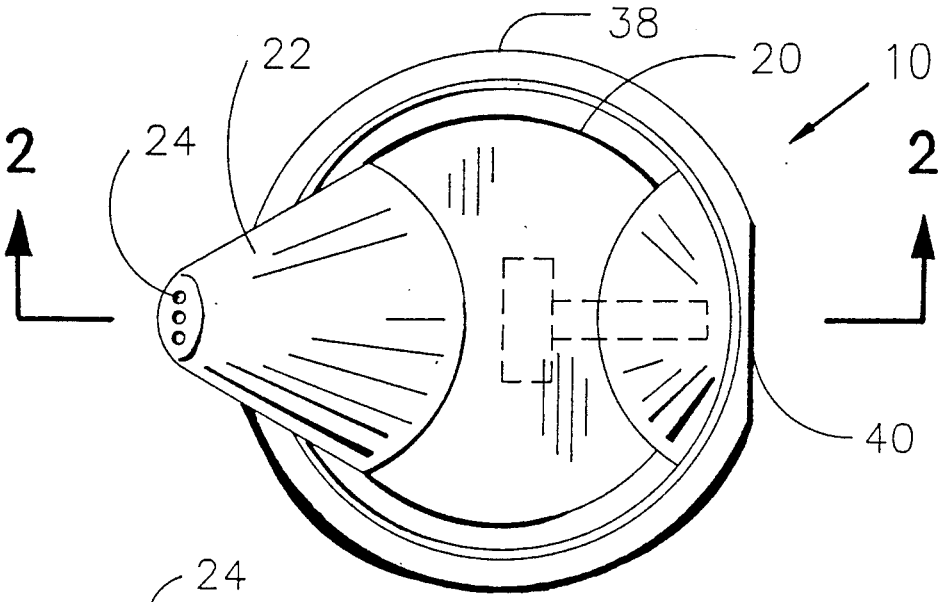
FIG. 1 is a top view of a combination drinking cup and lid for infants constructed in accordance with the present invention.
Figure 2:
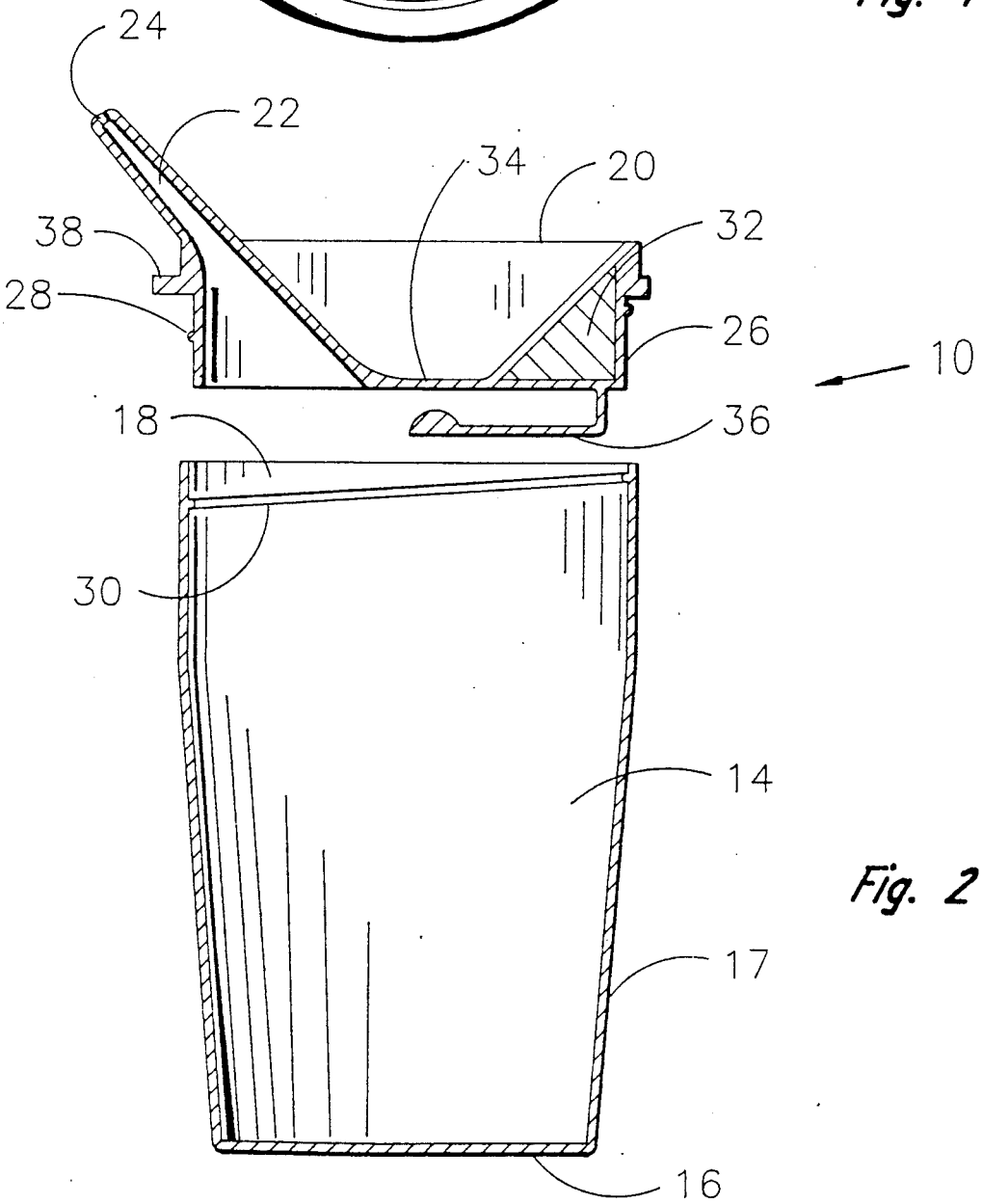
FIG. 2 is a sectional view taken along section line 2—2 of FIG. 1 showing the lid apart from the cup.

Referring to the drawings in detail, FIGS. 1 and 2 illustrate one embodiment of the present invention. The device 10 includes a cup 14 which will receive the liquid therein. The cup 14 has a substantially flat base 16 upon which the cup will normally rest. The base 16 has a circular outer edge, from which an upstanding continuous wall 17 extends longitudinally.

The wall 17 may be in the form of a frustum although the wall might also be substantially cylindrical. Longitudinally opposite the base 16, the cup 14 has an open end 18. As seen in FIGS. 1 and 2, the continuous wall has both a cylindrical part and a frustum part. The center of the cup 14, thus, forms a longitudinal axis.

The open end 18 is adapted to receive a lid 20. The lid 20 may have an extending spout 22 which terminates in a small number of openings 24 to allow liquid to exit from the openings 24.

The spout 22 is adapted to easily fit in a child's mouth (not shown) and is near the circumferential edge of said lid 20.

The lid 20 has a portion 26 having a cylindrical edge. The diameter of the cylindrical edge is slightly smaller than the inside diameter of the cylindrical wall 17. The cylindrical edge portion 26 has a thread 28 which cooperates with a thread 30 on the inside of the cylindrical wall near the open end 18. Accordingly, the lid may be screwed onto and secured to the cup. When it is desired to remove the lid for refilling or cleaning, the lid may be unscrewed from the cup.

Although the lid is threadably secured to the cup in the present embodiment, other methods of attachment such as a friction-fit between the lid and cup might be employed.

The lid has a weight 32 which is located near the circumferential edge of the lid radially opposed from said spout. As shown, the weight is 180° radially apart from the spout. In the present embodiment, the weight is fabricated into the lid and is not visible from the exterior. It will be appreciated that the weight may be incorporated into the lid in other arrangements, so long as it is radially opposed to the spout.

An additional feature may be observed from the drawing in FIG. 2. The lid 20 has a flat portion 34 which will be interior to the cup and lid when combined together. Extending from the lid is a clip arm 36 which is parallel to the flat portion.

Figure 5:
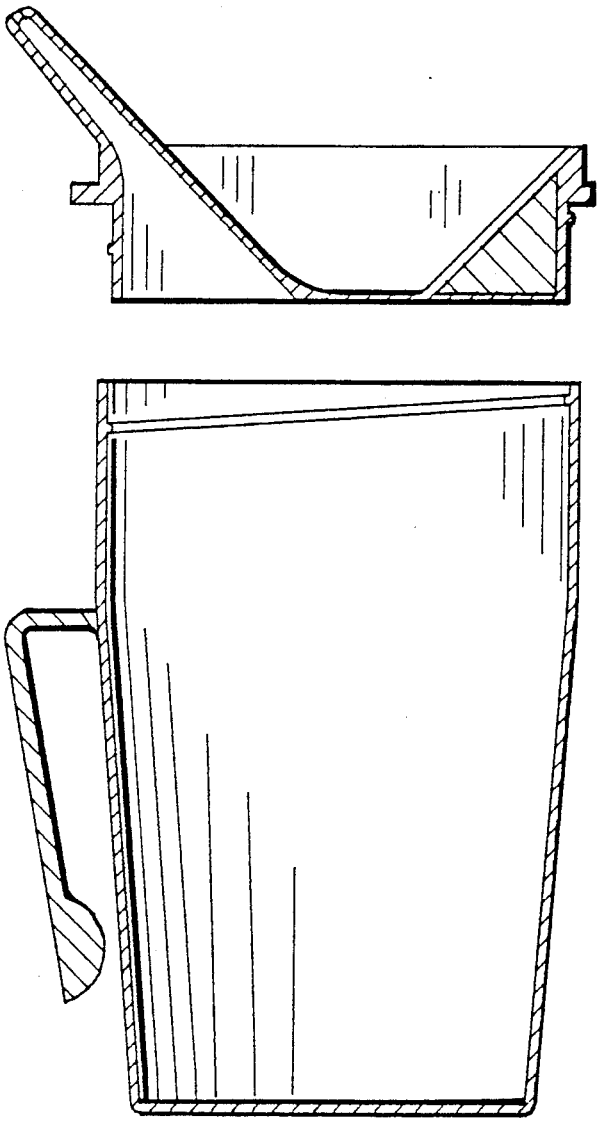
FIG. 5 is a sectional view of an alternate embodiment of a combination drinking cup and lid for infants.

When the cup and lid are to be washed in a dishwasher or, alternatively, when the cup and lid are to be stored, the clip arm 36 may be used to secure the lid 20 to the cup 14. In order to do so, the lid 20 will be unscrewed from the cup and the clip 36 will be secured to the wall 17 near the opening. Alternatively, the clip arm might be incorporated into the cup itself, as seen in FIG. 5.

The lid 20 has a rim 38. A portion 40 of the rim may be slightly flattened. The flattened portion 40 will be radially opposed to the spout 22, as seen in FIG. 2.

If the cup is tipped over off of the base 16 onto the wall 17, the force of gravity will cause the weight to be drawn down towards the surface. This force will cause the cup to rotate about the longitudinal axis. At the same time, the spout will move to the farthest position away from the surface. Accordingly, the spout 22 will be positioned with its openings 24 directed away from the surface.

Figure 3:
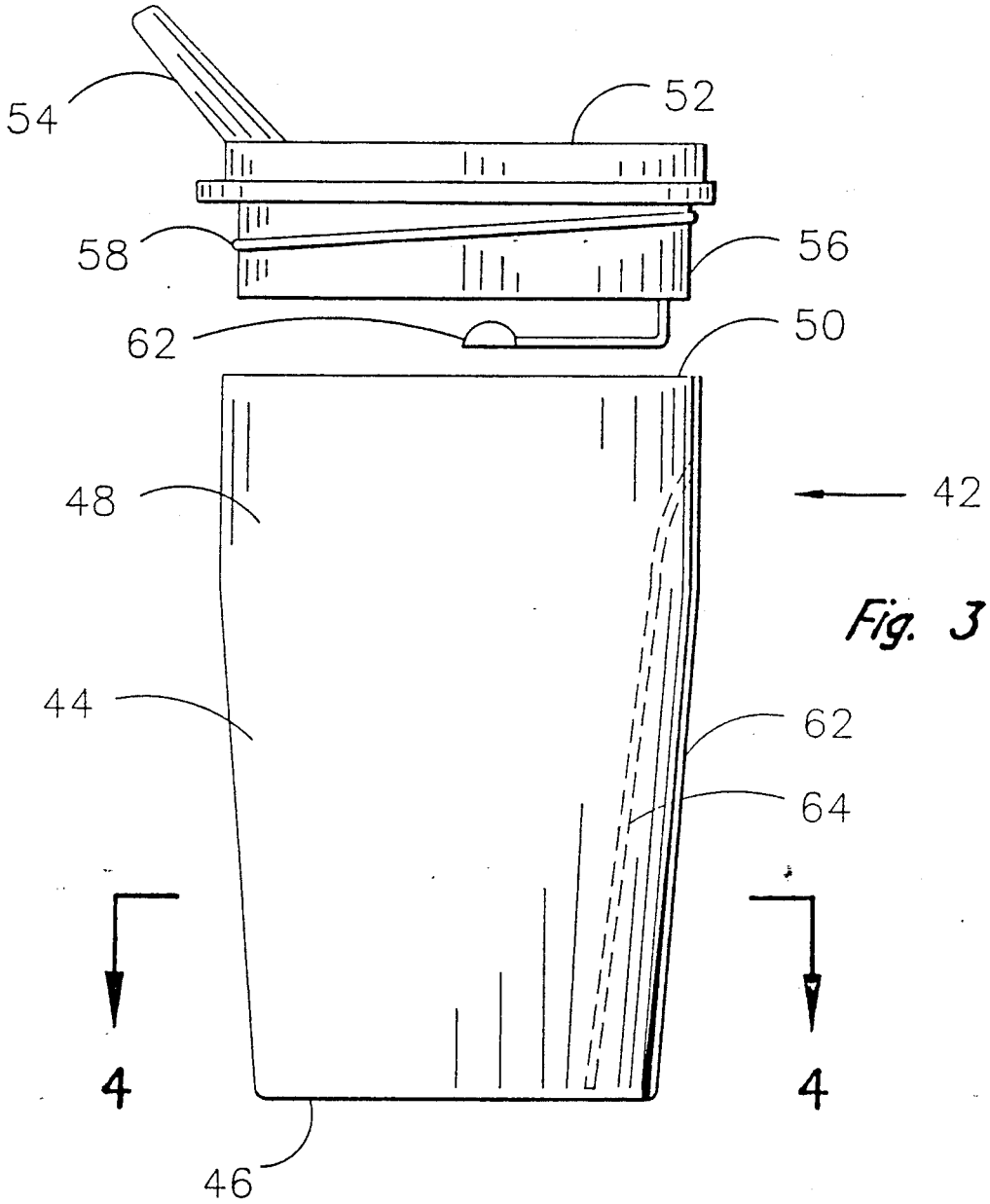
FIG. 3 is a front elevational view of an alternate embodiment of a combination drinking cup and lid for infants constructed in accordance with the present invention showing the lid apart from the cup.
Figure 4:
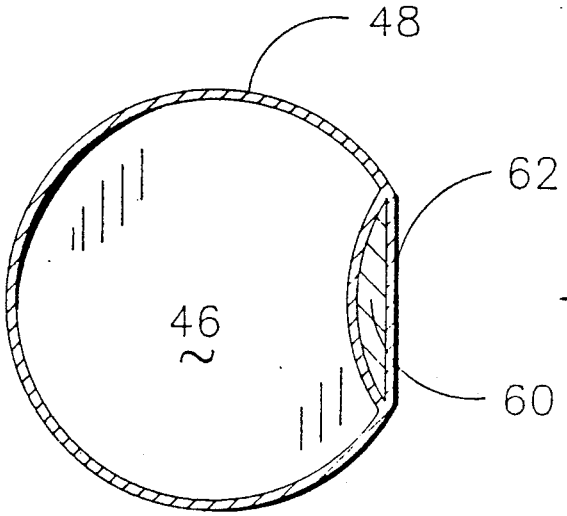
FIG. 4 is a sectional view taken along section line 4—4 of FIG. 3.

FIGS. 3 and 4 illustrate an alternate embodiment 42 of the present invention. A cup 44 has a substantially flat base 46 upon which the cup will normally rest. The base has a substantially circular edge from which extends upwardly a continuous wall 48. The wall 48 may extend upward in the form of a cylinder or a frustum or, as shown, a combination of the two. The center of the cup, thus, forms a longitudinal axis.

The wall 48 extends longitudinally upward from the base 46 to an open end 50. The open end 50 is adapted to receive a lid 52. The lid 52 may have an extending spout 54 along with a number of openings (not shown) to allow liquid to exit therefrom. The spout 54 is near the circumferential edge of the lid 52.

The lid 52 has a portion 56 having a cylindrical edge. The diameter of the cylindrical edge portion 56 is slightly smaller than the inside diameter of the cylindrical wall 48. The cylindrical edge portion 56 is threaded with thread 58 which cooperates with a thread (not shown) on the inside of the cylindrical wall 48 near the open end 50. Accordingly, the lid may be screwed onto the cup or unscrewed from the cup.

In the embodiments shown in FIGS. 3 and 4, the lid 52 is not weighted. Alternatively, a weight is located within the cup 44 running longitudinally along the wall 48 of the cup 44. The weight can readily be observed from FIG. 4.

When the lid 52 is connected to the cup 44 by threadably screwing the lid to the cup, the spout will be radially opposed to the weight 60. As will be readily observed, the weight is located 180° radially from the spout 54.

A clip arm 62 extends from the lid 52 so that the lid may be clipped to the cup during cleaning in a dishwasher or during storage.

The cup 44 may have a longitudinal portion 62 flattened, as best seen in FIG. 4.

If the cup is tipped over off of the base 46 and onto the wall 48, the force of gravity will cause the weight to be drawn down towards the surface. This force will cause the cup to rotate about the longitudinal axis. At the same time, the spout will move to the farthest position away from the surface.

It has been found that the amount of weight required in either embodiment in order to cause the cup to rotate about its longitudinal axis is small. Accordingly, the overall weight of the drinking cup and lid will not be excessive for the child.

Whereas the present invention has been described in particular relation to the drawings attached hereto, it should be understood that other and further modifications, apart from those shown or suggested herein, may be made within the spirit and scope of this invention.

What is claimed is:

1. A combination drinking cup and lid which comprises:

a cup having a continuous substantially cylindrical wall and a substantially circular opening at a longitudinal end of said cylindrical wall; and a removable lid for closure of said opening in said cup, said lid having a substantially circular edge mating with said circular opening, a spout near the circumferential edge, and a weight near said circumferential edge radially opposed from said spout, whereby when said cylindrical wall rests on a surface, the force of gravity will radially rotate said cup and said lid so that said weight will rotate towards said surface and said spout will rotate away from said surface.

2. A combination drinking cup and lid as set forth in claim 1 wherein said cup is threaded near said opening and said lid is threaded near said edge so that said cup may be threadably engaged with said lid.

3. A combination drinking cup and lid as set forth in claim 1 wherein at least a portion of said lid forms a plane and including a clip arm extending from said removable lid and parallel to said plane so that said clip arm may be attached to said cup during cleaning and storage.

4. A combination drinking cup and lid as set forth in claim 1 including a clip arm extending from said cup wall so that said clip arm may retain said lid during cleaning and storage.

5. A combination drinking cup and lid which comprises:

a cup having a wall substantially in the form of a frustum and a substantially circular opening at one longitudinal end of said wall; and a removable lid for closure of said opening in said cup, said lid having a substantially circular edge mating with said circular opening, a spout near the circumferential edge, and a weight near said circumferential edge radially opposed from said spout, whereby when said wall rests on a surface, the force of gravity will radially rotate said cup and said lid so that said weight will rotate towards said surface and said spout will rotate away from said surface.

6. A combination drinking cup and lid as set forth in claim 5 wherein said cup is threaded near said opening and said lid is threaded near said edge so that said cup may be threadably engaged with said lid.

7. A combination drinking cup and lid as set forth in claim 5 wherein at least a portion of said lid forms a plane and including a clip arm extending from said removable lid and parallel thereto.

8. A combination drinking cup and lid which comprises:

a cup having a substantially cylindrical wall and a substantially circular opening at a longitudinal end of said cylindrical wall;

a removable lid for closure of said opening, said lid having a substantially circular edge mating with said circular opening, and at least a portion of said lid forming a plane; and a clip arm extending from said removable lid and parallel to said planar portion, so that said clip arm may be engaged with said cup for storage or washing.

9. A combination drinking cup and lid as set forth in claim 8 wherein said cup is threaded near said opening and said lid is threaded near said edge so that said cup may be threadably engaged with said lid.

10. A combination drinking cup and lid which comprises:

a cup having a continuous longitudinal wall substantially in the form of a frustum and a substantially circular opening at one longitudinal end of said wall; and a removable lid for closure of said opening in said cup, said lid having a substantially circular edge mating with said circular opening, a spout near the circumferential edge, and a weight near said circumferential edge radially opposed from said spout, whereby when said wall rests on a surface, the force of gravity will radially rotate said cup and said lid so that said weight will rotate towards said surface and said spout will rotate away from said surface.

11. A combination drinking cup and lid as set forth in claim 10 wherein said cup is threaded near said opening and said lid is threaded near said edge so that said cup may be threadably engaged with said lid.

* * * * *